United States Patent [19]

Cooke

[11] Patent Number: 4,739,890

[45] Date of Patent: Apr. 26, 1988

[54] CLOSURE FOR CONTAINER

[76] Inventor: Carl W. Cooke, 5106 Perry Park Rd., Sedalia, Colo. 80135

[21] Appl. No.: 61,487

[22] Filed: Jun. 15, 1987

[51] Int. Cl.[4] ..... B65D 55/02

[52] U.S. Cl. ..... 215/222; 215/217

[58] Field of Search ..... 215/222, 217, 223, 330, 215/332

[56] References Cited

U.S. PATENT DOCUMENTS

| | | | |
|---|---|---|---|
| 4,434,903 | 3/1984 | Cooke | 215/222 |
| 4,526,281 | 7/1985 | Herr | 215/222 |
| 4,567,992 | 2/1986 | Davis | 215/222 |
| 4,627,547 | 12/1986 | Cooke | 215/222 |

*Primary Examiner*—G. T. Hall

*Attorney, Agent, or Firm*—Plante, Strauss, Vanderburgh

[57] ABSTRACT

A closure for containers provided with one or more closure projections adapted to cooperate with means on the container for securing the closure in sealing position over the open mouth of the container. The closure of the invention can be used with containers designed for child resistant packaging or with containers designed for conventional closures. The closure includes a top wall and a depending skirt portion. One or more locking projections are formed on the inner wall surface of the skirt portion. The locking projection has an upper surface facing the top wall of the closure on which is formed a lug which extends parallel to the axis of the closure so that the locking projection has a generally inverted T-shaped configuration including a pair of oppositely extending arms which extend normal to the lug. The extending arms define support surfaces which cooperate with the securing means of the container to prevent cocking or tilting of the closure when in the locked and sealed position on the container.

11 Claims, 2 Drawing Sheets

CLOSURE FOR CONTAINER

FIELD OF THE INVENTION

The invention relates to closures for containers and more particularly to locking and securing elements on the closure which are adapted to be used with both containers provided with conventional closure elements and with containers having locking elements for locking the closure thereon.

BACKGROUND OF THE INVENTION

In recent years there has been great interest in providing packaging in which the closure and container combinations which are designed so that the closure can be removed from the container only by special manipulation. In this fashion the packages are considered to be child-safe in that the closures are generally unremovable by children.

In certain cases, however, the provision of a child-resistant packaging is unnecessary such as is the case where harmless substances are packaged in the container. In such a case the provision of the child resistant locking feature is undesirable from the manufacturers standpoint due to the cost of providing especially designed closure elements and from the users standpoint due to the inconvenience which can be associated with child resistant packages. Packaging manufacturers are normally required to maintain an inventory of closures and containers for both the conventional packaging and for the child-resistant packaging configurations. This can lead to problems of having the proper container and closure available for the particular packaging job and also can be expensive in that two separate inventories must be maintained.

Accordingly, it would be highly desirable to have a closure which is provided with one or more closure elements adapted to be used with both the child resistant container and with conventional containers provided with non-locking closure elements.

SUMMARY OF THE INVENTION

In accordance with the present invention there is provided a closure for containers, such as for example pharmaceutical containers and the like, which is provided with one or more locking projections adapted to cooperate with means on the container for securing the closure in sealing position over the open mouth of the container. The locking projection is adapted for use with containers provided with conventional helical continuous threads or other conventional means on the container for drawing the closure into sealing position without locking it on the container. The locking projections are also adapted for use with containers with means for securing and locking the closure on the container so as to make the package child-resistant. With the closure of the present invention it is unnecessary to maintain a separate inventory of closures for conventional packaging and for child-resistant packaging. Further, when utilized in the child-resistant packaging mode, the locking projection of the closure cooperates with the locking elements on the container to provide a stable platform for the closure when it is in the locked and sealed position thus providing uniform sealing pressure around the mouth of the container and substantially eliminating tilting or rocking of the closure when secured on the container. This feature makes the inadvertent removal of the closure, without proper manipulation, more difficult and reduces wear on the locking projection of the closure so that the child-resistant feature is maintained over prolonged use of the closure. In addition, the sealing function of the closure is improved by the maintenance of uniform sealing pressure around the mouth of the container.

In accordance with standard design, the closure comprises a top wall which is designed to close and seal the mouth of a container and a cylindrical depending skirt portion which defines a cylindrical inner wall surface for receiving a neck portion and mouth of a container. A resilient member, which is carried either by the container or the closure, is provided for urging the closure axially upwardly when the closure is in the sealing position for improving the sealing function and for aiding in maintaining the closure in the sealed position.

The inner wall surface of the depending skirt of the closure is provided with closure means which cooperate with closure means on the neck portion of the container for detachably securing the closure on the container. As will be described hereinafter, these means cooperate to draw the closure over the neck of the container so that the top wall of the closure abuts the rim of the mouth of the container to effect sealing and these means act further to retain the closure in the sealing position until the closure is manipulated for removal. The securing means on the closure are adapted to cooperate with the container securing means designed for the purpose to provide a child resistant locking action when the closure is in the sealing position. The securing means on the closure also are adapted to cooperate with container securing means of conventional configuration to draw the closure axially downwardly over the mouth of the container without the child resistant locking feature so that the closure may be removed from the container without any special manipulation.

In accordance with the present invention the securing means are disposed about the inner wall surface of the depending skirt of the closure and comprise one or more locking projections formed integrally on the inner wall surface of the skirt portion with upper surfaces facing the top wall of the closure. Where more than one locking projection is employed, the projections are spaced apart uniformly about the circumference of the skirt portion. A locking lug having a width less than the width of the locking projection is formed on the locking projection with its base on the upper surface of the locking projection. The lug extends from its base parallel to the axis of the closure toward the top wall thereof and the end of the locking lug opposite the base is free and defines a contact surface for contact with the container closure means during operation of the closure in the non-locking configuration. The portion of the locking projection extending beyond the base of the locking lug defines on each locking projection at least one arm which is normally disposed with respect to the locking lug. Preferably the locking lug is formed in the mid portion of the locking projection so that the locking projection defines a pair of oppositely extending arms. The surfaces of the extending arms facing the top wall of the closure define support surfaces which cooperate with the securing means of the container to prevent cocking or tilting of the closure when in the locked and sealed position on the container. When utilized as a child-resistant package, the securing means on the container comprise pairs of spaced-apart projecting lugs which correspond in position and number to the locking projections on the closure. The projecting lugs are spaced-apart to define therebetween a locking channel for receiving the free end of the locking lug of the locking projections to effect locking of the closure on the container and the lower faces of the projecting lugs are contiguous with the support surface of the respective arm of the locking projections to provide a stable support base for the closure when it is in the locked position on the container.

When the package is to be used in the more conventional non-child resistant mode, the securing means on the container may comprise one or more turns of a continuous projecting helical thread which engages the free end of the locking lug of the locking projection and responsive to turning of the closure causes the closure to be drawn axially downwardly over the mouth of the container and into the sealing position. As an alternate embodiment, the container may be provided with a plurality of sloping projecting lugs which have lower camming surfaces to act against the contact surface of the lug of the locking projection on the closure thereby to urge the closure axially downwardly over the mouth of the container.

In a preferred form of the invention the contact surface on the lug of the locking projection may be arcuate or sloped so as to conform with the slope of the thread means on the container thereby to maximize the area of contact between the leg and the surface of the thread means.

Other aspects and advantages of the invention will become apparent from the following detailed description of the preferred embodiment taken in conjunction with the accompanying drawings.

DESCRIPTION OF THE PREFERRED EMBODIMENT

Figure 1:
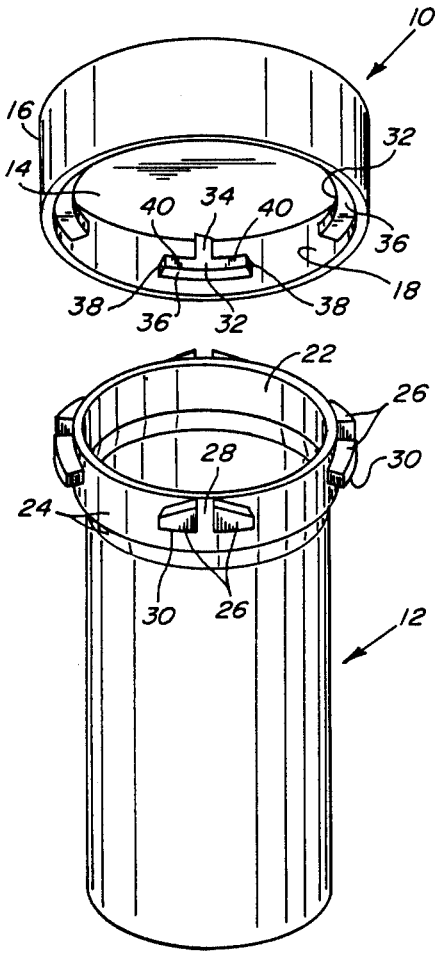
FIG. 1 is an isometric view of a closure and container showing a portion of the interior of the closure illustrating inverted T-shaped members disposed about the inner surface of the depending skirt of the closure and corresponding spaced apart projecting lugs on the neck portion of the container for child-resistant packaging in accordance with the invention.

FIG. 1 illustrates a closure 10 constructed in accordance with the present invention and a container 12 in which the container is provided with cooperating securing means configured for operation in the child-resistant mode.

The closure 10 comprises a top wall 14 and a depending cylindrical skirt 16 having an inner wall surface 18. In the view shown, the top wall 14 is provided with a resilient means which comprises an élastomeric liner 20 which overlies the top wall of the closure 10. As an alternative, the closure 10 may be provided with an inner depending resilient member of conventional design (not shown) having a free end which is received by the container 12 and which is compressed when the closure 10 is drawn into sealing position on the container 12. Various embodiments of the resilient means are well known in the art and do not form a part of this invention.

The container 12 includes an open mouth 22 and a neck portion 24 which is adapted to be received within the cylindrical skirt 16 of the closure 10. The neck portion 24 of the container 12 may be expanded in outside diameter with respect to the body of the container 12 as illustrated or may be of the same or smaller outside diameter with respect to the body of the container 12. Four pairs of spaced-apart projecting lugs 26 are disposed about the neck portion 24 of the container 12 and are preferably located adjacent the rim of the open mouth 22. Each pair of the projecting lugs 26 defines a locking channel 28 and each lug defines a lower face 30 which is preferably planar.

Disposed about the inner wall surface 18 of the depending skirt 16 of the closure 10 are four inverted T-shaped locking projections 32 which are positioned about the depending skirt to correspond with the position of the pairs of projecting lugs 26 on the container 12. Each T-shaped projection 32 defines a locking lug 34 which extends parallel to the axis of the closure 10 and which is joined at the end farthest from the top wall 14 by a transverse member 36 which defines oppositely extending arms 38 which extend normal to the locking lug 34. The opposite end of the locking lug 34 is free and defines a contact surface 39. The upper face of each of the extending arms 38 defines a support surface 40 which is contiguous with the lower face 30 of a respective projecting locking lug 26 when the closure 10 is in the sealed and locked position on the container 12. The locking lug 34 is configured to be received in the locking channel 28 defined by the pairs of projecting lugs 26 to lock the closure 10 on the container 12 and to prevent its removal by ordinary twisting of the closure 10 with respect to the container 12.

Figure 2:
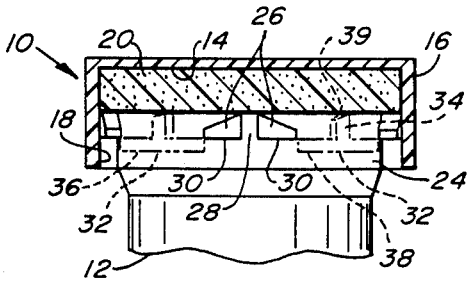
FIGS. 2, 3 and 4 are side views, partially in section, illustrating the operation of the closure and container of FIG. 1.
Figure 3:
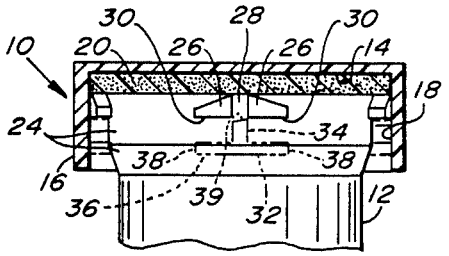
Figure 4:
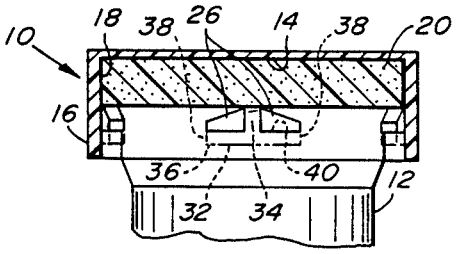

The operation of the closure 10 and container 12 of FIG. 1 are most clearly illustrated in FIGS. 2–4 in which the closure 10 is placed over the mouth 22 of the container 12 (FIG. 2) and is moved into the locking position by the application of pressure to move the closure 10 axially toward the container 12 followed by twisting the closure 10 with respect to the container 12 until the free end of the locking lug 34 is aligned with the locking channel 28 (FIG. 3). Upon release of the pressure the locking lug 34 is received in the locking channel 28 and the support surface 40 of each of the extending arms 38 is brought into contiguity with the lower face 30 of a respective lug 26 (FIG. 4). It will be noted that during the positioning of the closure 10, the elastomeric liner 20 is compressed against the rim of the mouth 22 of the container 12 and when the locking lug 34 of the inverted T-shaped projection 32 is aligned with the locking channel 28 and the axial pressure is released, the resilient member urges the closure 10 axially upwardly so as to retain the support surface 40 of the arms 38 and the lower face 30 of the projecting lugs 26 in contiguity and to retain the locking lug 34 in the locking channel. Preferably, the elastomeric liner 20 is maintained under compression and is not completely relaxed when the closure 10 is in the sealed and locked position. In this fashion the resilient liner 20 aids in sealing the mouth 22 of the container 12. The closure 10 is removed from the container 12 by reversing the procedure. The necessity of applying axial force to remove the locking lug 34 from the locking channel 28 coupled with the twisting movement necessary to move the T-shaped projection 32 out of alignment with the corresponding pair of lugs 26 in order to remove the closure 10 is beyond the ability of most children.

Figure 5:
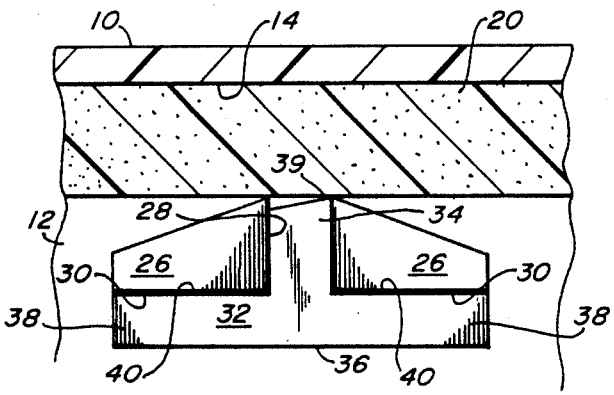
FIG. 5 is a side view, partially in section and in enlarged scale, showing the closure and container of FIG. 1 in the sealed and locked position.

As more clearly shown in FIG. 5, in the locked and sealing position, the support surface 40 of the arms 38 acting against the lower faces 30 of corresponding lugs 26 provide a support base so that a stable platform is defined between each of the inverted T-shaped projections 32 and the pairs of projecting lugs to prevent cocking or tilting of the closure 10. This ensures that a uniform sealing pressure is applied around the rim of the mouth 22 of the container 12 and prevents unnecessary wear and stress on the locking lug 34 of the inverted T-shaped projection 32 and the portions of the projecting lugs 26 immediately adjacent the locking channel 28.

As mentioned, the closure 10 of the present invention is adapted to be used with conventional thread means for utilization of the closure in non-child resistant packaging. With conventional uninterrupted threads it will be understood that it is necessary that the closure 10 be cocked when in the sealed position since the inverted T-shaped projections 32 are aligned about the circumference of the inner wall of the depending skirt 16 of the closure. The effects of such cocking are, however, largely overcome by the resilient member which is compressed and in its compressed state exerts substantially uniform pressure about the rim of the mouth 22 of the container 12. Such an embodiment in illustrated in FIG. 6 wherein like numbers represent like parts and where the container 12 is provided with a continuous projecting helical thread 42 on the neck portion 24. The closure 10 is twisted on in the conventional fashion with the inverted T-shaped projection 32 disposed between the turns of the thread 42 and the contact surface 39 defined at the free end of the locking lug 34 acting against the undersurface of the thread to draw the closure axially toward the container 12 responsive to turning the closure with respect to the container 12.

Figure 6:
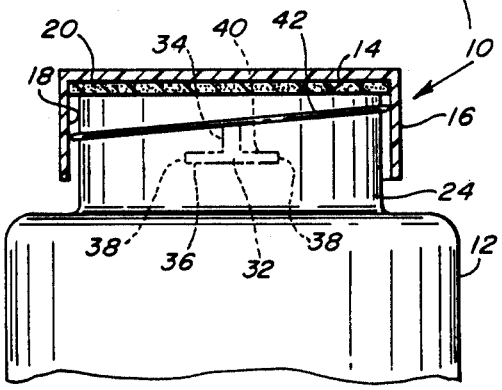
FIG. 6 is a side view, partially in section and cut away for compactness of illustration showing a closure and container operated in a conventional non-child resistant mode of operation.
Figure 7:
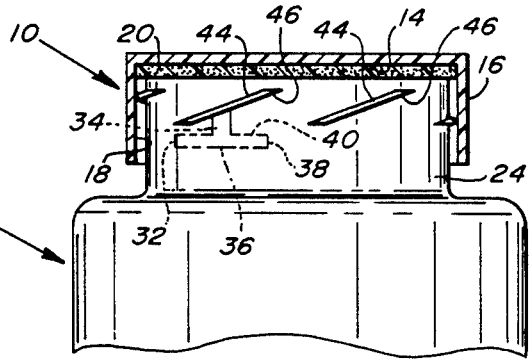
FIG. 7 is a side view, partially in section and cut away for compactness of illustration, of a closure and container illustrating an alternate embodiment of securing means on the container for operation in the non-child resistant mode.

A more preferred embodiment is illustrated in FIG. 7 in which the neck portion 24 of the container 12 is provided with a series of downwardly sloping projecting thread elements 44 the undersurfaces of which define camming surfaces 46 for engagement with the contact surface 39 of the free end of the locking lug 34 of the inverted T-shaped projection 32 to axially draw the closure 10 down into sealing engagement on the container 12 responsive to turning the closure 10 with respect to the container 12. With the embodiment of the invention as shown in FIG. 6 there is no tilting or cocking of the closure 10 when in the sealing position since the downwardly sloping thread elements 44 are aligned about the circumference of the neck portion 24 of the container 12.

In the embodiments of the invention illustrated in FIGS. 6 and 7 the closure 10 is applied to the container 12 by twisting the closure in a clockwise direction. The closure 10 is simply removed by twisting the closure in a counter-clockwise direction.

In the embodiments illustrated, the contact surface 39 at the free end of the locking lug 34 is illustrated as being essentially flat or planer. However, in the preferred form of the invention the contact surface 39 is disposed at an angle or is arcuate to prevent undue wear of the contact surface of the locking lug or the camming surface of the thread elements 44 on the container 12. In addition, greater contact surface 39 is achieved between the contact surface 39 and the camming surfaces 46 of the thread elements 44 thus improving the operation of the closure 10.

Figure 8:
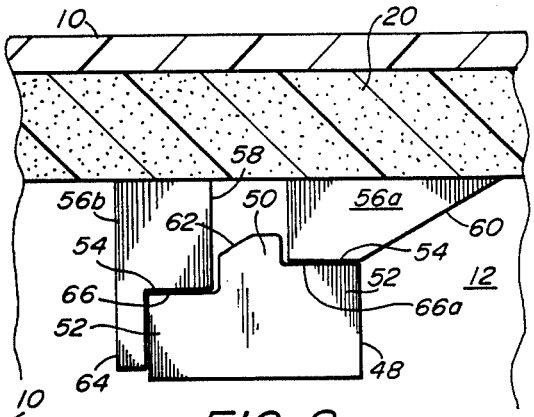
FIG. 8 is a side view, partially in section and in enlarged scale, showing another embodiment of the invention.

The invention has thus far been described in connection with a preferred embodiment utilizing inverted T-shaped locking projections on the closure. However, the invention is not to be construed as so limited. Other configurations of both the locking projections on the closure and the projecting lugs on the container can be used with excellent results. Thus, as shown in FIG. 8 a locking projection 48 comprises a locking lug 50 and a pair of arms 52 extending normal to the locking lug 50. Each of the arms 52 defines a support surface 54, however the support surface 54 of each arm 52 is spaced in a plane normal to the axis of the closure 10 that is different from that of the support surface 54 of the other arm 52 of the locking projection 48. The container 12 is provided with corresponding pair of projecting lugs **56*a* and 56*b* which define therebetween a locking channel 58 for receiving the locking lug 50 when the closure 10 is in the sealed and locked position. The leading surface 60 of the projecting lug 56*a* is inclined to define a camming surface which cooperates with a corresponding inclined portion 62 of the free end of the locking lug 50 to draw the closure axially downwardly over the open mouth 22 of the container 12 as the closure is twisted. The projecting lug 56*b* includes an extension 64 which serves as a stop when the locking lug 50 is in alignment with the locking channel 58. The lower face 66*a* of the projecting lug 56*a* lies in substantially the same plane as and is contiguous with the support surface 54 of the corresponding arm 52 when the corresponding locking elements are in the locked position. Similarly, the lower face 66*b* of the projecting lug 56*b* is contiguous with its corresponding support surface 54 although the lower faces 66*a* and 66*b* are spaced different distances from the mouth of the container 12. Thus a stable support base for the closure 10 is provided even though the support surface 54 of the arms 52 of the locking projection 48** are in different planes.

Various embodiments and modifications of the invention have been described in the foregoing description and illustrated in the drawings. It will be understood, that minor changes may be made in the details of construction as well as in the combination and arrangement of parts without departing from the spirit and scope of the invention as claimed.

Having described the invention I claim:

1. A closure for a container having a neck portion including an open mouth, said closure comprising a top wall for closing and sealing the mouth of said closure and a depending skirt portion defining a cylindrical inner wall surface for receiving the neck portion of said container, securing means disposed on the neck portion of said container and corresponding securing means on the cylindrical inner wall surface of said closure for coperatively detachably securing said closure thereon, the improvement wherein said securing means on said closure comprise at least one locking projection integrally formed on the inner wall surface of said depending skirt portion of said closure for maintaining said closure in a sealing position over the mouth of said container when said locking projection is engaged with said cooperating on said container, said locking projection including an upper surface facing said top wall, a locking lug having its base formed on said upper surface extending axially toward said top wall of said closure, the extending end of said locking lug being free, the width of said locking projection being greater than the width of said locking lug so that a portion of said locking projection defines at least one arm normally disposed to said locking lug, the upper surface of the portion of said locking projection defining said arm comprising a support surface for cooperation with said securing means of the container to provide a support base for said closure when in the locked and sealed position on said container.

2. The closure of claim 1 comprising a plurality of said locking projections on said inner wall surface of said depending skirt portion.

3. The closure of claim 1 wherein the free end of said lug defines a contact surface.

4. The closure of claim 1 wherein said locking projection is an inverted T-shaped member.

5. The combination of a container having a neck portion including an open mouth, and a closure therefor comprising a top wall for closing and sealing the mouth of said closure and a depending skirt portion defining a cylindrical inner wall surface for receiving the neck portion of said container, said cylindrical inner wall surface having at least one locking element disposed thereon, means disposed on the neck portion of said container for cooperation with said closure locking elements to detachably secure said closure in a sealing position on said container, resilient means normally urging said closure axially out of the sealing position, said closure locking element comprising at least one locking projection including an upper surface facing said top wall of said closure, a locking lug having its base formed on said upper surface extending axially toward said top wall of said closure, the extending end of said locking lug being free, the width of said locking projection being greater than the width of said locking lug so that a portion of said locking projection defines at least one arm normally disposed to said locking lug, the upper surface of the portion of said locking projection defining said arm comprising a support surface for cooperation with said securing means of the container to provide a support base for said closure when in the locked and sealed position on said container.

6. The combination of claim 5 wherein said securing means on said neck portion of said container consists of a continuous helical thread, the cross section of said thread projecting radially outwardly from said container neck portion to define a lower contact surface, the free end of said lug engaging said lower contact surface of said thread to draw said closure axially into sealing position on said container and to compress said resilient means responsive to the rotation of said closure with respect to said container.

7. The combination of claim 5 wherein said securing means on said neck portion of said container comprises a pair of spaced apart projecting lugs each having a lower face, a locking channel being defined between said pair of lugs for receiving said free end of the lug of said locking projection responsive to the urging of said resilient member thereby to effect a locking of said closure on said container, the support surface of each of said arms being substantially aligned with the lower face of a corresponding lug of said pair and in contact therewith to provide a support base for said closure to prevent the axial removal of said closure while said closure is locked on said container.

8. The combination of claim 6 wherein a plurality of said pairs of projecting lugs are spaced about the neck portion of said container and a plurality of corresponding locking projections are disposed on the inner surface of the depending skirt portion of said closure, the lower faces of the lugs on said container contacting the support surfaces of the respective arms of said locking projections on said closure to provide uniform sealing pressure by said closure over the mouth of said container and to prevent any substantial movement of said closure while locked on said container.

9. The combination of claim 5 wherein said locking projections on said closure comprise inverted T-shaped members.

10. The combination of claim 5 wherein said securing means on said neck portion of said container comprises a plurality of sloping projecting lugs having lower camming surfaces and a plurality of inverted T-shaped projections are disposed on the inner surface of the depending skirt portion of said closure, the free end of the lug of said inverted T-shaped projection engaging the camming surface of a lug to draw said closure axially into sealing position on said container and to compress said resilient means responsive to the rotation of said closure with respect to said container.

11. The combination of claim 5 wherein said securing means on said neck portion of said container comprises a continuous projecting helical thread having a lower surface and a plurality of inverted T-shaped projections are disposed on the inner surface of the depending skirt portion of said closure, the free end of the lug of said inverted T-shaped projection engaging the lower surface of said projecting helical thread to draw said closure axially into sealing position on said container and to compress said resilient means responsive to the rotation of said closure with respect to said container.

* * * * *